United States Patent [19]

Stoia

[11] Patent Number: 4,708,007

[45] Date of Patent: Nov. 24, 1987

[54] DOOR LOCK MOUNTING SYSTEM

[76] Inventor: Harry J. Stoia, 30 Lincoln St., Brighton, Mass. 02135

[21] Appl. No.: 906,939

[22] Filed: Sep. 15, 1986

Related U.S. Application Data

[63] Continuation-in-part of Ser. No. 746,787, Jun. 20, 1985, abandoned.

[51] Int. Cl.[4] ..... E05B 9/08

[52] U.S. Cl. ..... 70/451; 70/417; 70/452; 70/461

[58] Field of Search ..... 70/451, 452, 417, 448, 70/461

[56] References Cited

U.S. PATENT DOCUMENTS

| | | | |
|---|---|---|---|
| 554,965 | 2/1896 | Squires | 70/452 |
| 3,260,081 | 7/1966 | Simon | 70/452 |
| 3,899,907 | 8/1975 | Prahl | 70/452 |
| 4,338,806 | 7/1982 | Cox | 70/417 |
| 4,522,048 | 6/1985 | Davis | 70/417 |
| 4,530,223 | 7/1985 | Oliver | 70/417 |

FOREIGN PATENT DOCUMENTS

| | | | |
|---|---|---|---|
| 93005 | 12/1960 | France | 70/452 |
| 1376584 | 9/1964 | France | 70/451 |

*Primary Examiner*—Robert L. Wolfe

*Attorney, Agent, or Firm*—Wolf, Greenfield & Sacks

[57] ABSTRACT

A tamperproof, secure mounting system for a deadbolt lock is adapted to accommodate a wide range of door thicknesses. The device includes a front section and a rear section which are passed through the front and rear ends of a hole formed through the door. The portions of the front and rear sections which meet within the door hole are threaded together to clamp the door between the front and rear sections. Supplemental fastening means are provided to secure the front and rear sections together to prevent further relative rotation between the two. The front section carries the tumbler mechanism so that thekey slot of the tumbler mechanism is exposed at the front of the door. The rear section is hollow and provides a passageway by which the rear end of the tumbler mechanism may be connected to the lock which mounts on the inner face of the door. Means are provided for registering the rearwardly facing surface of the rear section with the lock.

18 Claims, 8 Drawing Figures

10
12
14
22
24
26
28
30
32
34
36
38
40
42
44
48
50
54
56
58
60
62
66
68
70
72
74
76
78
80
82
84

DOOR LOCK MOUNTING SYSTEM

This application is a continuation-in-part of application Ser. No. 747,787, filed June 20, 1985 and now abandoned, entitled DOOR LOCK MOUNTING SYSTEM.

BACKGROUND OF THE INVENTION

This invention relates to devices for mounting surface mounted locks to a door. Because of the wide range of door thicknesses in commercially available doors, difficulties are encountered when fitting and mounting surface mounted locks, such as deadbolt locks. It is common for such locks to be provided with a set of fittings intended to be used with varying door thicknesses so that the correct set of fittings may be selected at the installation site. Even with a set of such fittings, often the fit is imprecise and difficulties in alignment and centering of the lock with respect to the door and the lock mount are common. As a result, installation of surface mounted locks sometimes can be quite difficult, frustrating and time consuming. It is among the primary objects of the invention to provide an improved lock mounting system for surface mounted locks which avoids these and other difficulties.

SUMMARY OF THE INVENTION

The lock mounting device has a front section and a rear section which mate together through a hole formed in the door. The front section has a threaded barrel which is passed rearwardly through the hole in the door and an integral enlarged front flange which is exposed at the front of the door. The rear section includes an internally threaded, housing and an enlarged rear flange and is inserted into the hole in the door from the inside. The internally threaded housing of the rear section is threaded onto the threaded barrel of the front section until the flanges of the front and rear section firmly grip the door therebetween. The front section carries the tumbler mechanism so that the key slot of the tumbler mechanism is exposed at the front of the door and so that the rearwardly projecting actuating member of the tumbler mechanism extends toward the rear section.

After the front and rear sections have been screwed together tightly to clamp the door, the front and rear sections, in one embodiment of the invention, are further secured to each other by a supplemental retaining means. In that illustrative embodiment the supplemental retaining means comprises one or more screws extending at a forward/rearward direction to further connect the front and rear sections together and to mechanically interlock them so that they cannot rotate or unscrew with respect to each other.

The invention also includes a means to assure central registration of the deadbolt lock with the mounting device on the inside of the door. To that end the rear flange of the rear section is provided with a plurality of circumferentially spaced holes which receive pins formed on the forwardly facing surface of the lock. After the lock mounting mechanism is secured on the door the lock is secured to the inside surface of the door with the pins received in the circumferentially spaced holes on the flange to assure precise registration and alignment of the lock. The operating mechanism of the deadbolt lock is attached to the actuating member of the tumbler mechanism by a connecting rod which extends rearwardly through the rear section and connects the rear pin of the tumbler mechanism with the drive pin for the deadbolt mechanism.

In other illustrative embodiments of the invention, the supplemental retaining means is omitted and other means are provided for preventing rotation of the front and rear sections with respect to each other and also as a unit. In those embodiments of the invention, a face plate is securely mounted on the front surface of the door. The face plate is provided with an enlarged aperture to receive the rearwardly extending threaded barrel on the front section. The front section and face plate are provided with cooperative means to prevent rotation of the front section. Cooperative means also are provided between the lock and the rear section to independently prevent rotation of the rear section. The cooperative means for the rear section may comprise the registration means by which the lock engages the rear flange of the rear section.

It is an object of the invention to provide an improved mounting system for surface mounted locks which can accommodate a door of any thickness.

Another object of the invention is to provide a mounting system for a surface mounted lock which is highly resistant to tampering.

Another object of the invention is to provide a mounting system for a surface mounted lock having means for assuring proper registration of the surface mounted lock with the mounting and operating mechanism.

Another object of the invention is to provide a mounting system for a surface mounted lock which is easily and quickly installed.

DESCRIPTION OF THE DRAWINGS

The foregoing and other objects and advantages of the invention will be appreciated more fully from the following further description thereof, with reference to the accompanying drawings wherein.

DESCRIPTION OF THE PREFERRED EMBODIMENT

Figures 1, 2:
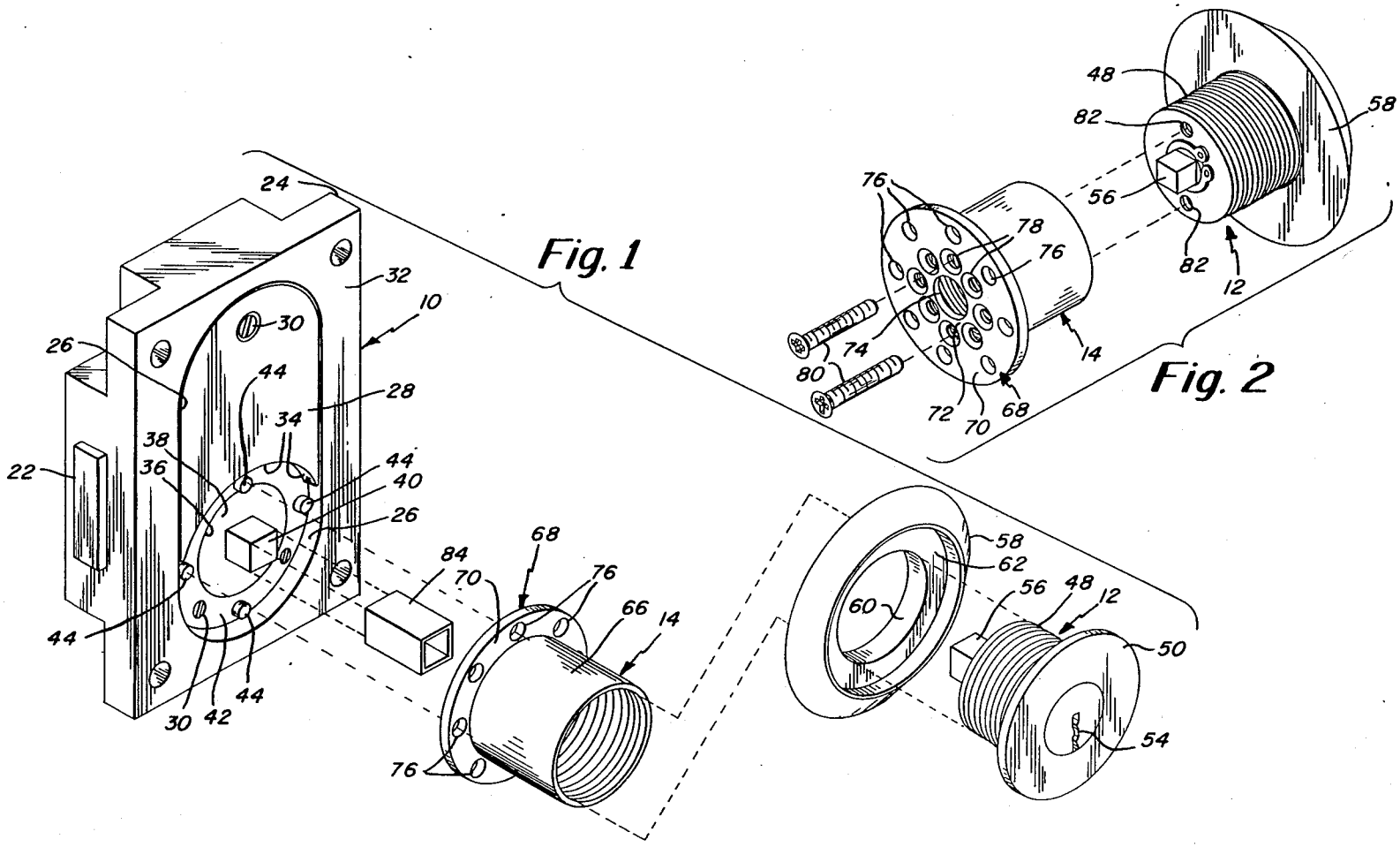
FIG. 1 is an exploded illustration of the beadbolt lock and mounting mechanism.
FIG. 2 is an exploded illustration of the front and rear sections of the mounting mechanism.

FIG. 1 illustrates, in exploded arrangement, the relationship of the surface mounted deadbolt lock 10 and the lock mounting device including the front section 12 and rear section 14. The lock 10 is intended to be mounted to the inner surface 16 of the door 18, as by screws, suggested at 20 in FIG. 3. The deadbolt lock 10 has a casing 24 which contains an actuating mechanism (not shown) for the deadbolt 22. Preferably the lock mechanism is of the type described in my U.S. Pat. No.

3,815,390 issued June 11, 1974. The forwardly facing side of the casing 24 has an opening 26 for access to the interior lock mechanism. The opening 26 is covered by a casing cover 28 which is secured to the casing 24 by screws 30. The casing cover 28 is flush with the door-engaging forwardly facing surface 32 of the casing 24 except for a circular cutout portion indicated at 34 which cooperates with the circular edge of the opening 26 to define a circular recess. As will be described, the circular recess receives a flange formed on the rear section 14 of the mounting device.

The circular recess portion has a circular opening 36 which receives a rotatable member 38 which forms part of the lock mechanism. The rotatable member 38 is an integral part of the lock mechanism and operates in unison with the deadbolt 22. Rotation of the member 38 operates the deadbolt. Formed integrally with the rotatable member 38 is a drive pin 40 which is connected to the lock mechanism as will be described. The rotatable member 38 may, for example, be formed integrally with the key cam indicated in my aforementioned U.S. Pat. No. 3,815,390 by the reference character 30. Thus, from the foregoing it will be understood that the recess defined by the circular cutout defines a circular periphery bounded by the cutout 34 in the casing cover 28 and the circular portion of the opening 26. The bottom of the circular recess is defined by the surface of the rotatable member 38 and a surrounding annular surface 42 of the casing cover 28. A plurality of registration pins 44 are circumferentially spaced about and protrude from the annular surface 42. As will be described, registration pins 44 cooperate with the flange on the rear section 14 to register the lock 10 properly in place.

Figure 3:
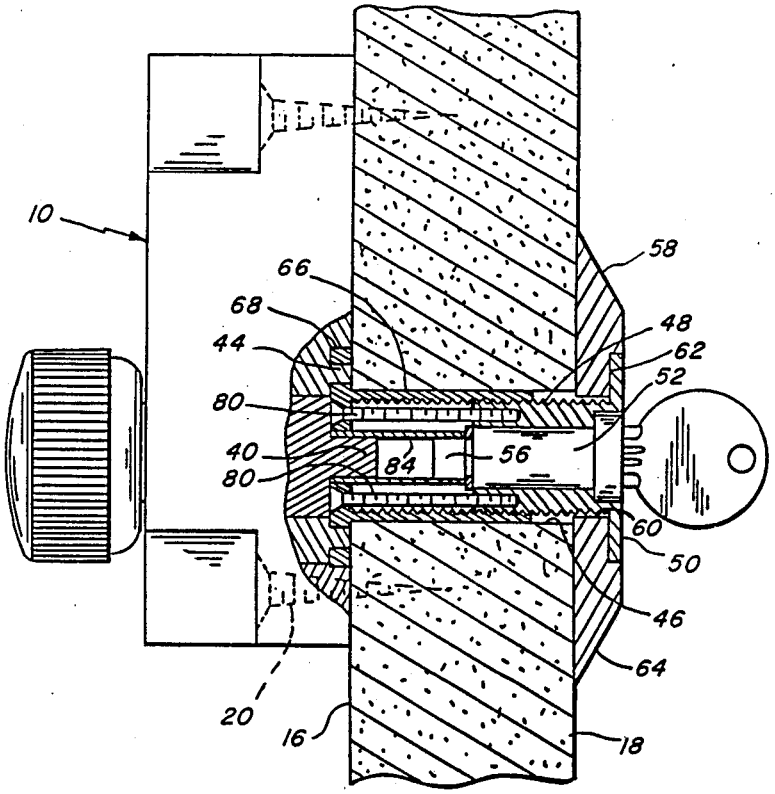
FIG. 3 is a sectional elevation through a door having lock mounted to the door by the mounting mechanism.

The mounting device, including the front section 12 and rear section 14, is mounted in the door through a hole 46 formed in the door 18 (see FIG. 3). The front section 12 includes a rearwardly extending, externally threaded barrel 48. An enlarged front flange 50 is formed integrally with the barrel 48. The front section 12 carries the tumbler mechanism 52 so that the key slot 54 is exposed at the front of the front flange 50. The rear end of the tumbler mechanism 52 is exposed so that the rearwardly projecting actuating member 56 of the tumbler mechanism extends rearwardly beyond the rear end of the threaded portion 48 of the front section 12. When the front section 12 is mounted on the door the threaded barrel 48 extends into the hole 46 formed in the door. In the embodiment shown in FIGS. 1–3 an enlarged beveled ring 58 is interposed between the front flange 50 of the front section 12 and the front face of the door 18. The beveled ring 58 has a central aperture 60 through which the threaded barrel 48 extends, and has an annular shoulder 62 which receives the front flange 50 of the front section 12 so that the front face of the flange 50 and beveled ring 58 present a flush surface. The angle defined by the beveled edge 64 is acute so that the periphery of the ring 58 cannot be gripped by a tool. Additionally, there is no rotating connection between the ring 58 and the front section so that even if the ring 58 were gripped any rotation applied to the ring 50 would not be transmitted to the front section 12, thereby enhancing the tamperproof characteristic of the device.

The rear section 14 includes an internally threaded cylindrical housing 66 and an enlarged rear flange 68. The rear section 14 is inserted through the rearward side of the hole 46 in the door 18 and the front and rear sections are screwed together, with the threaded barrel 48 of the front section 12 being screwed into the internally threaded housing 66 on the rear section 14. The front and rear sections are screwed together tightly with the rear flange 68 of rear section 14 bearing firmly against the rear surface of the door 18 and with the rearwardly facing surface of front flange 50 of front section 12 and the beveled ring 58 being drawn firmly toward and into engagement with the front face of the door 18.

The rear flange 68 of rear section 14 has an outer circumferential portion indicated at 70 which extends radially outwardly beyond the circumference of the housing 66. The rear flange 68 also includes an inner circumferential portion, indicated at 72, which extends radially inwardly of the internally threaded housing 66. The inner periphery of the inner circumferential portion 72 defines a central hole 74 which provides a means for connection between the actuating member 56 of the tumbler mechanism and the drive pin 40 of the lock mechanism, as will be described. A plurality of circumferentially spaced holes 76 are formed in the outer circumferential portion 70 of the rear flange 68. The spacing of the holes 76 is such that they can received the registration pins 44 on the casing cover 28 in a number of different angular positions between the flange 68 and the lock 10. The inner circumferential portion 72 of the flange 68 also is provided with a plurality of holes 78 which preferably are countersunk. The holes 78 are equiangularly and circumferentially spaced. The holes 78 are intended to received retaining screws 80. As will be described, the retaining screws 80 are passed through a pair of the countersunk holes 78 and are screwed into threaded holes 82 formed in the rearwardly facing surface of the cylindrical wall of the barrel 48 on front section 12.

Assembly and installation of the device and the lock requires first that the through hole 46 first be formed through the door. The hole preferably is just large enough to receive the outer diameter of the housing 66 on the rear section 14, although precise tolerances are not required. Once the hole 46 has been formed the mounting device is assembled by passing the front section 12 through the opening 60 in the bevel ring 58 and then inserting the threaded barrel 48 of the front section through the front end of the door hole 46. The rear section 14 is simply inserted into the rear side of the door hole 46 and the front and rear sections 12, 14 are screwed together as illustrated in FIG. 3. The front and rear sections may be drawn very tightly together to grip the door very firmly by inserting an appropriate pronged wrenching tool into two or more of the holes 76 to tighten the rear section down firmly. When tightening down the front and rear sections a pair of holes 78 in the rear flange 68 are aligned with the threaded holes 82 and the front section 12 so that screws 80 can be passed through the holes 78 and screwed into the holes 82. The screws 80 serve further to secure the front and rear sections together and to prevent them from being rotated and unscrewed with respect to each other.

When the front and rear sections 12, 14 are secured in place the lock 10 can be applied and secured to the door. When placing the lock 10 a connector 84 is connected to the drive pin 40 and actuating member 56 so as to transmit rotational movement between the pin 40 and member 56. In the illustrative embodiment the connector 84 comprises a hollow square tube which fits over the square cross-section of each of the drive pin 40 and actuating member 56. The interconnection between the connector 84, pin 40 and member 56 provides for a certain degree of telescoping action to enable a single length of connector to accommodate a significant range of doors. The connector 84 may be placed first on the pin 40 so that together with the lock 10 it may mate with member 56 or, conversely, the connector 84 may first be placed through hole 74 and onto the member 56, with the pin 40 being inserted into the rear end of the connector 84 when the lock 10 is placed on the door. Placement of the lock on the door requires simply that the registration pins 44 be aligned with registration holes 76 on the rear flange 68. Once registered, the rear flange 68 will be received fully within the circular recess in the casing cover 28 and the door engaging surface 32 of the lock casing 24 will bear flush against the inner surface 16 of the door. The casing then may be secured to the door by screws 20.

Figure 4:
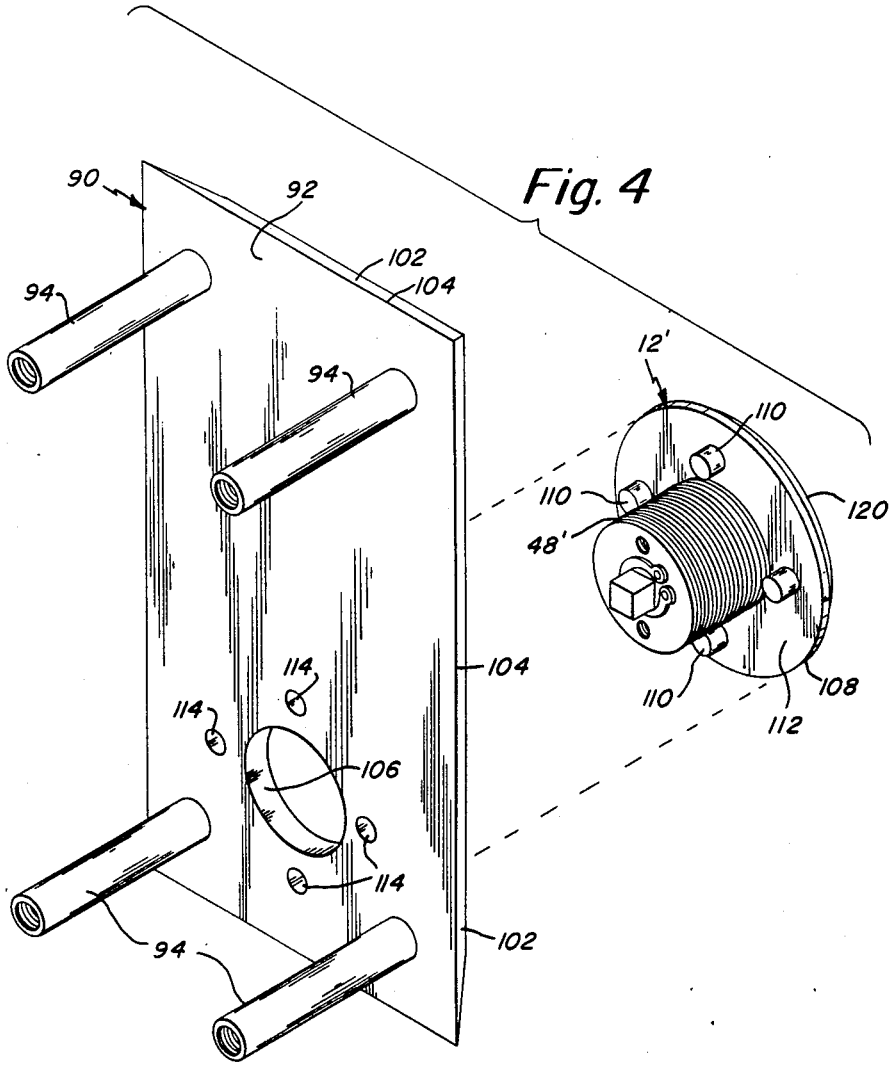
FIG. 4 is a perspective illustration of a modified form of front section and front door plate.
Figure 5:
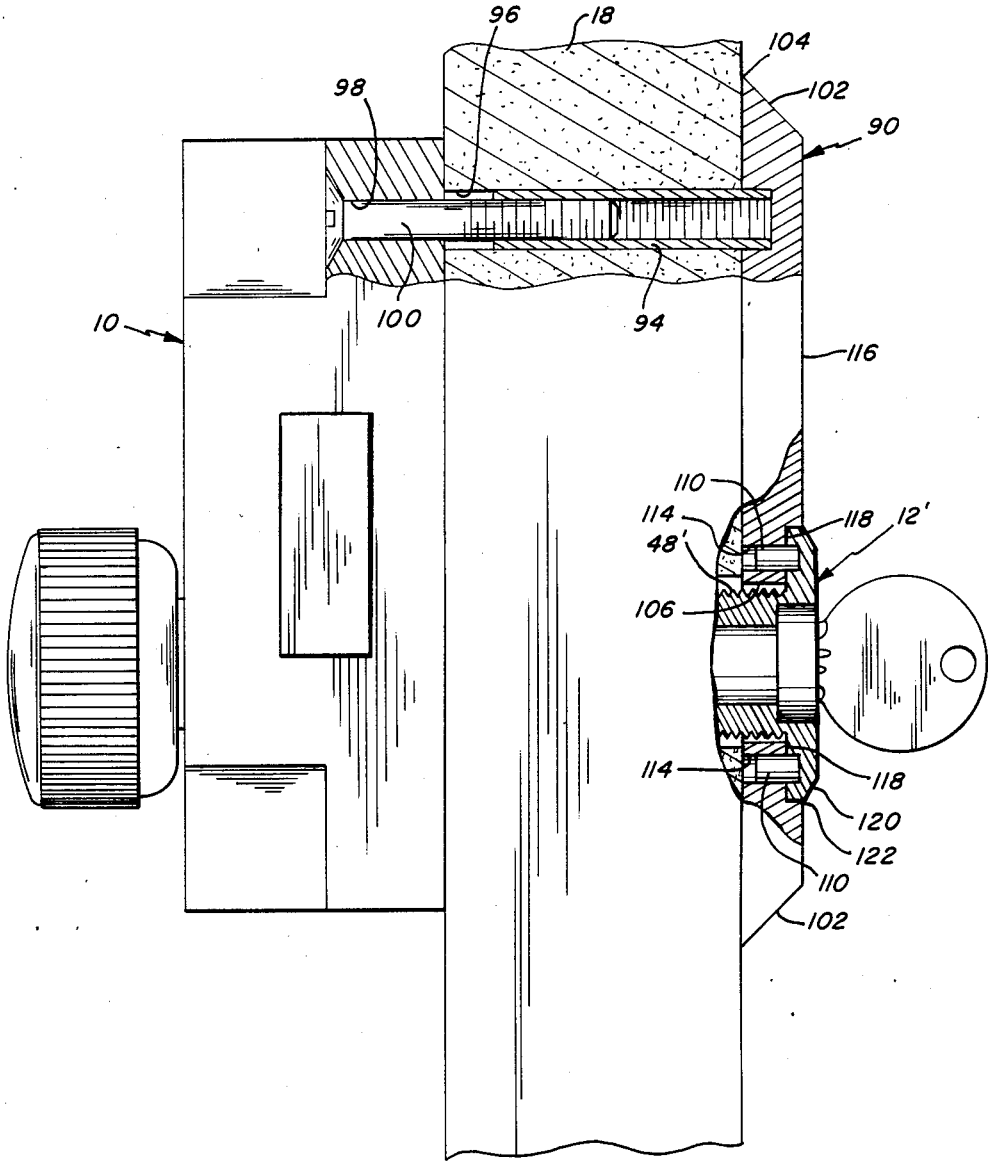
FIG. 5 is a partly broken away and sectional elevation through a door having the modified front section and front face plate shown in FIG. 4.

FIGS. 4 and 5 illustrate a modified form of the invention which enhances further the tamperproof features of the lock. In this embodiment the system includes an enlarged area face plate 90 which receives a modified form of front section 12'. The face plate 90 has a rear surface 92 which lies flush against the front of the door 18 as shown in FIG. 5. A plurality of rearwardly extending hollow internally threaded studs 94 are secured to and extend rearwardly from the face plate 90. The studs 94 are intended to be received in holes 96 formed through the door 18 as shown in FIG. 5. The studs 94 are arranged so as to be in alignment with holes 98 formed through the body of the surface mounted deadbolt lock 10. When the lock is installed, it is secured by bolts 100 which extend through holes 98 in the lock body, into the holes 96 formed in the doors and are threaded into the threaded hollow studs 94. The beveled periphery forms a relatively sharp peripheral edge 104. The bevel 102 and sharp edge 104 make it very difficult to engage or grip the face plate 90 so as to tamper with it.

The face plate includes a hole 106 which is positioned on the plate 90 so as to be in alignment with the lock mechanism and to receive the rearwardly extending threaded barrel 48' of the front section 12'. The front section 12' includes a front flange 108 which has a plurality of pins 110 extending rearwardly from the rear face 112 of the front flange 108. In the illustrative embodiment four pins 110 are provided and preferably are arranged in equal circumferential spacing for spacing about the central axis of the front section 12'. A plurality of holes 114, equal in number and spacing to the pins 110, are formed through the face plate 90 and are arranged to receive the pins 110 when the front section 12' is mated with the face plate 90. The pins 110 may be formed as separate members and press fitted into receptive sockets formed in the rear face 112 of the front flange 108. As shown in FIG. 5 the front face 116 of the face plate 90 is provided with a shallow circular recess 118 of a diameter which receives the front flange 108 of the front section 12'. The depth of the recess 118 is selected so that the bevel 120 formed peripherally about the peripheral margin of the flange 108 merges smoothly with the front face 116 of the face plate 90, as indicated at the juncture 122 in FIG. 5. Preferably the extent to which the front flange projects forwardly of the front face 116 of the face plate 90 is kept to a minimum to enhance the tamperproof characteristic of the lock.

When the lock is installed the engagement of the pins 110 with the holes 114 provides an additional measure of security in that further protection is provided against rotating the lock mechanism in its entirety to operate the lock. With the pins 110 engaged in the holes 114 of the face plate, it would be impossible to rotate the front section 12' even if the front section 12' somehow could be gripped. Additionally, the face plate 90 is prevented from being rotated by means of the studs 94 and the manner in which they are secured to the door and to the deadbolt lock 10. In this embodiment, the front and rear sections are prevented from being rotated with respect to each other as well as in unison. In this embodiment the supplemental retaining means by which the front and rear sections are connected together to prevent relative rotation, such as the screws 80 of the embodiment of FIGS. 1–3, may be omitted.

Other cooperative means between the front section and the face plate may be employed to prevent rotation of the front section.

Figure 6:
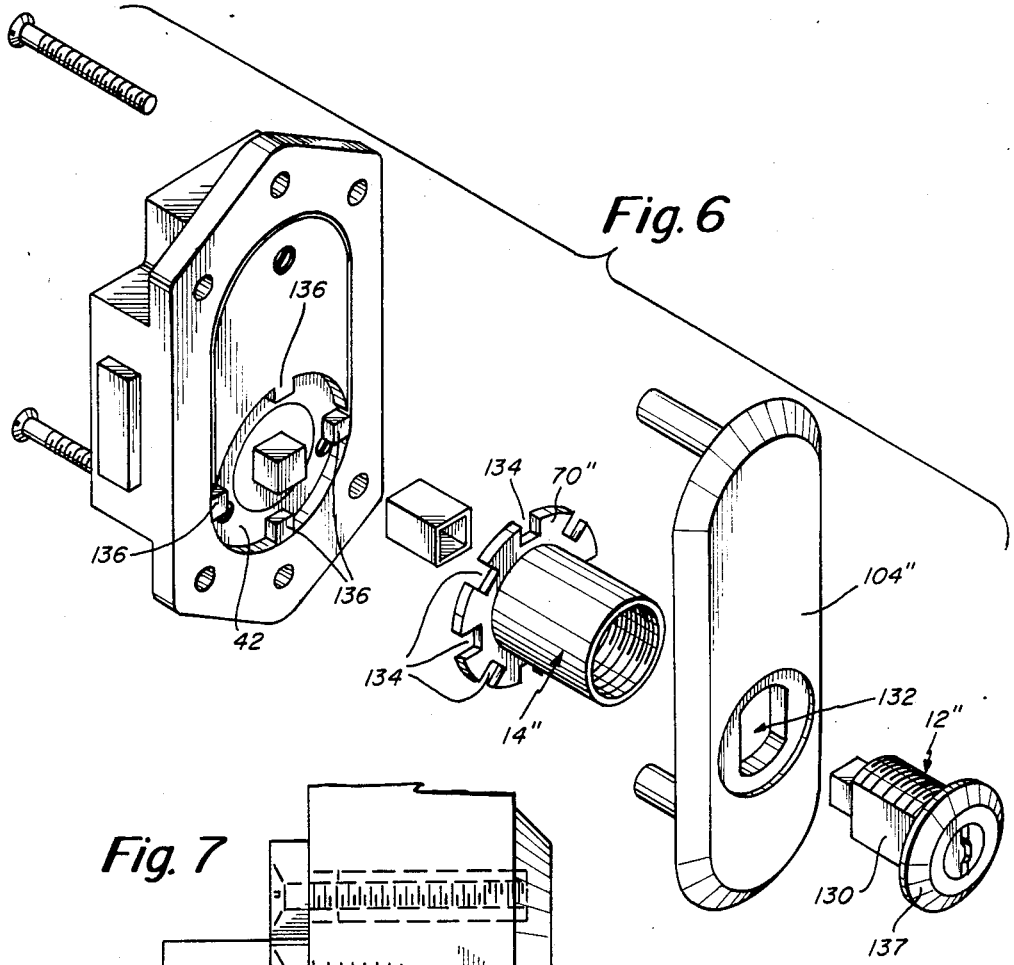
FIG. 6 is an exploded illustration of another embodiment of the invention.
Figure 7:
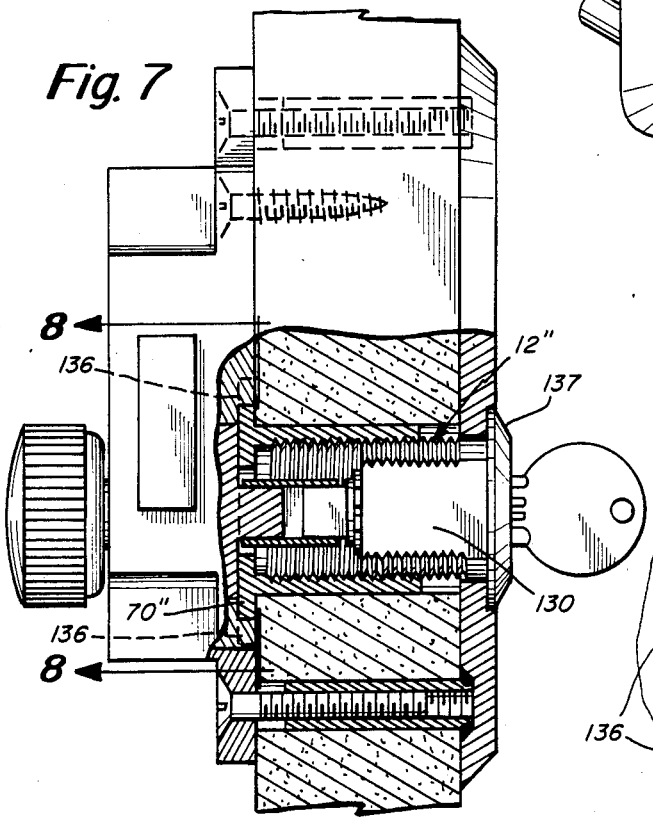
FIG. 7 is a sectional illustration similar to FIG. 3 illustrating, in section, the embodiment of FIG. 6 mounted on a door.
Figure 8:
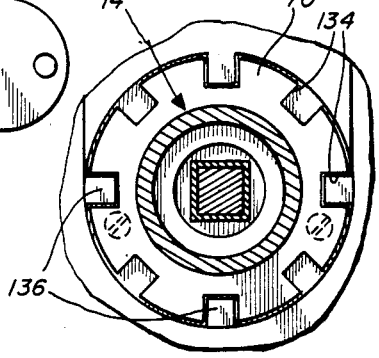
FIG. 8 is an illustration as seen along the line 8—8 of FIG. 7.

For example, FIGS. 6–8 illustrate a modified form of the embodiment illustrated in FIGS. 4 and 5. In this modification the front section 12'' is prevented from rotating with respect to the face plate 104'' by forming the threaded barrel 48'' of the front section 12'' so that it is non-circular in cross-section. For example, as shown, the barrel may be provided with one or more flats 130. The hole 132 formed in the face plate to receive the barrel of the front section and is formed with a mating non-circular hole, such as the hole having the flat as shown.

The rear section 14'' is prevented from rotation by engagement of the registration means on the lock with the mating registration means on the rear section. As shown, the rear section 14'' in this embodiment of the invention has an outer circumferential flange 70'' which is provided with a plurality of registration notches 134, corresponding to the holes 76 in flange 70 of the embodiment illustrated in FIGS. 1 and 2. In this modification, the holes are open at the periphery of the flange and mate with corresponding pins 136 extending from the annular surface 42 of the lock. The notches 134 and pins 136 preferably are a square shape. The square configuration for the peripheral registration notches 134 facilitates engagement with a tightening wrench adapted to engage the notches 134. As shown in FIGS. 7 and 8 when the front and rear sections 12'', 14'' are screwed together to grip the door between the flanges 136, 70'' of the front and rear sections, the lock may be secured to the door by screws and bolts in a manner in which the pins 136 engage the peripheral notches 134 in the flange 70''. When installing the lock, the rear section 14'' should be screwed tightly to the front section 12'' and in a position in which the notches 134 will be in registration with the pins 136 when the lock is mounted on the inside of the door. The pins 136 are equiangularly spaced and one of the pins 136 is located in the "twelve o'clock" position. When the rear section 14'' is screwed tightly onto the front section 12'', it should be positioned with anyone of the equiangularly spaced notches 134 in the "twelve o'clock" position The "twelve o'clock" position is preferred because it is relatively easy to position by eye the rear section 14''. In that configuration, the rear section 14'' is restrained from rotation by engagement of the pins 136 with the notches 134 and the front section 12'' is restrained from rotation by engagement of its non-circular barrel with the non-circular hole 132 formed in the face plate 104''. Thus, the front and rear sections are prevented from rotating with respect to each other as well as in unison.

From the foregoing it will be appreciated that the system enables a lock to be quickly and easily surface mounted to a door. The lock provides a high degree of tamperproof security with few parts and is usable with a wide range of door thicknesses. The lock mechanism may be easily detached and replaced without requiring disruption of the mounting device.

It should be understood that the foregoing description of the invention is intended merely to be illustrative thereof and that other modifications and embodiments of the invention may be apparent to those skilled in the art without departing from the spirit.

Having thus described the invention what I desire to claim and secure by letters patent is:

1. A mounting device for a surface mounted door lock having a drive member for actuating the lock and registration means, said device comprising:

a front section having a front flange and a rearwardly extending externally threaded barrel, said barrel being adapted to contain a tumbler mechanism;

a rear section having a rear flange and a forwardly extending internally threaded housing, the internally threaded housing being adapted to threadably receive the threaded barrel on the front section;

said barrel and housing of said front and rear sections, respectively, being adapted to be passed through a hole in a door and being adapted to be screwed together to grip the door between said flanges;

supplemental retaining means interconnecting the front and rear sections to prevent relative rotation of said front and rear sections thereby to prevent unscrewing of said sections once placed;

registration means formed on said rear flange of the rear section for cooperation with said registration means on the surface of the mounted lock whereby said surface mounted lock may be oriented in registration with the rear flange of the rear section;

means for connecting the tumbler mechanism with the drive member of the lock, said connecting means extending through the rear section.

2. A device as defined in claim 1 wherein said supplemental retaining means comprises screw means extending parallel to the axis of said front and rear sections and connecting said sections together.

3. A device as defined in claim 2 wherein said screw means further comprises:

said rear flange having an inner circumferential portion and having at least one hole formed therein;

the rear face of the externally threaded barrel having at least one threaded hole formed therein;

a screw extending through said aperture in the rear flange and being screwed into the threaded hole in the rear face of the externally threaded barrel.

4. A device as defined in claim 3 further comprising:

said externally threaded barrel having a pair of threaded holes located in predetermined space relation to each other;

the inner circumferential margin of the rear flange having a plurality of screw-receiving holes, said plurality of holes being an integer multiple of the number of threaded holes in the externally threaded barrel thereby to enable the front and rear sections to be secured with respect to each other in a plurality of relative angular positions.

5. A device as defined in claim 1 wherein said registration means comprises:

said rear flange having an outer circumferential margin, the outer circumferential margin having a plurality of circumferentially spaced holes therein;

a plurality of projections formed on the forwardly facing side of the surface mounted lock, said projections being circumferentially spaced so as to be received in the circumferential openings in the outer circumferential portion of the rear flange, said holes in the rear flange being in number and integer multiple of the number of projections on the lock.

6. A device as defined in claim 5 further comprising:

the portion of the lock having said projections defining a circular recess, the depth of said recess being substantially equal to the thickness of said rear flange, the diameter of the recess being sufficiently large to receive the rear flange.

7. A device as defined in claim 1 further comprising:

a beveled ring surrounding the front section and being located between the front flange and the front surface of the door.

8. A device as defined in claim 1 further comprising:

a supplemental means for preventing rotation of the front section with respect to the door on which the lock is mounted.

9. A device as defined in claim 8 wherein the supplemental means comprises:

at least one pin secured to and extending rearwardly from the front flange of the front section;

means mounted to the door having an aperture adapted to receive the pin, said door mounted means being secured so as to prevent rotation of the front section with respect to the door.

10. A device as defined in claim 9 wherein the door mounted means comprises:

a face plate adapted to be securely mounted on the front surface of the door;

the face plate having an enlarged opening adapted to receive the rearwardly extending threaded barrel of the front section;

said at least one pin receptive hole being formed in the face plate and being positioned to receive the rearwardly extending pin on the front section.

11. A device as defined in claim 10 wherein there are a plurality of said pins circumferentially spaced about the central axis of the front section and wherein the face plate has a plurality of holes adapted to receive the pins.

12. A device as defined in claim 10 wherein the face plate further comprises:

a plurality of rearwardly extending studs adapted to extend through holes formed in the door; and means for securing the studs to the surface mounted lock casing at the inner surface of the door.

13. A mounting device for a surface mounted door lock having a drive member for actuating the lock and registration means, said device comprising:

a front section having a front flange and a rearwardly extending externally threaded barrel, said barrel being adapted to contain a tumbler mechanism;

a rear section having a rear flange and a forwardly extending internally threaded housing, the internally threaded housing being adapted to threadably receive the threaded barrel of the front section;

said barrel and housing of said front and rear sections, respectively, being adapted to be passed through a hole in the door and being adapted to be screwed together to grip the door between said flanges;

means for preventing rotation of said front and rear sections with respect to each other and as a unit;

registration means formed on said rear flange of the rear section for cooperation with said registration means on the surface mounted lock whereby said surface mounted lock may be oriented in registration with the rear flange of the rear section; and means for connecting the tumbler mechanism with the drive member of the lock, said connecting means extending through the rear section.

14. A device as defined in claim 13 wherein said means for preventing relative and unitary rotation of said front and rear sections comprises:

a face plate adapted to be securely mounted to the front surface of the door, the face plate having an enlarged opening adapted to receive the rearwardly extending threaded barrel of the front section;

said front section and face plate having cooperative means to prevent rotation of the front section with respect to the face plate;

said registration means on the rear flange of the rear section and on the lock being constructed and arranged to prevent relative rotation of the rear section with respect to the lock whereby when said lock is securely mounted to the door said cooperative means will prevent rotation of the rear section; and means for connecting the tumbler mechanism with the drive member of the lock, said connecting means extending through the rear section.

15. A mounting device for a surface mounted door lock having a drive member for actuating the lock and registration means, said device comprising:

a front section having a front flange and a rearwardly extending externally threaded barrel, said barrel being adapted to contain a tumbler mechanism;

a rear section having a rear flange and a forwardly extending internally threaded housing, the internally threaded housing being adapted to threadably receive the threaded barrel of the front section;

said barrel and housing of said front and rear sections, respectively, being adapted to be passed through a hole in a door and being adapted to be screwed together to grip the door between said flanges;

a face plate adapted to be securely mounted on the front surface of the door and having an enlarged opening adapted to receive the rearwardly extending threaded barrel of the front section;

cooperative means for preventing rotation of the front section with respect to the face plate;

cooperative means on the door lock for engagement with the rear flange of the rear section to prevent rotation of the rear section; and means for connecting the tumbler mechanism with the drive member of the lock, said connecting means extending through the rear section.

16. A surface mounted door lock and mounting device therefor comprising:

said door lock having a drive member for actuating the lock and registration means;

a front section having a front flange and a rearwardly extending externally threaded barrel, said barrel being adapted to contain a tumbler mechanism;

a rear section having a rear flange and a forwardly extending externally threaded housing, the internally threaded housing being adapted to threadably receive the threaded barrel of the front section;

said barrel and housing of said front and rear sections respectively being adapted to be passed through a hole in a door and being adapted to be screwed together to grip the door between said flanges;

a face plate adapted to be securely mounted on the front surface of the door, the face plate having an enlarged opening adapted to receive the rearwardly extending threaded barrel portion of the front section;

means for preventing relative rotation of the front section with respect to the face plate;

said lock having means in engagement with the rear flange of the rear section to prevent rotation of the rear section whereby the front and rear sections are prevented from being rotated with respect to each other and in unison; and means for connecting the tumbler mechanism with the drive member of the lock, said connecting means extending through the rear section.

17. A device as defined in claim 13 further comprising:

the rear flange of the rear section having a plurality of peripheral notches formed about the circumference of the flange, the notches being equiangularly spaced;

said registration means on the surface mounted lock comprising a plurality of equiangularly spaced circumferentially located pins adapted to engage the notches on the rear flange of the rear section, said notches being greater in number than said pins.

18. A device as defined in claim 17 wherein said notches and said pins are square-shaped.

* * * * *